US008221591B2

(12) United States Patent
de Para et al.

(10) Patent No.: US 8,221,591 B2
(45) Date of Patent: Jul. 17, 2012

(54) COKING DRUM SUPPORT SYSTEM

(75) Inventors: Domingo E. de Para, Nassau Bay, TX (US); Claude A. Lafleur, Baton Rouge, LA (US); Ronald J. Kobialka, Kingwood, TX (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 711 days.

(21) Appl. No.: 12/230,823

(22) Filed: Sep. 5, 2008

(65) Prior Publication Data

US 2010/0059357 A1 Mar. 11, 2010

(51) Int. Cl.
*C10B 7/14* (2006.01)

(52) U.S. Cl. ..... 202/266; 202/268

(58) Field of Classification Search ..... 202/239, 202/242, 266, 268, 267.1; 196/130
See application file for complete search history.

(56) References Cited

U.S. PATENT DOCUMENTS

| | | | | |
|---|---|---|---|---|
| 5,228,825 | A * | 7/1993 | Fruchtbaum et al. | 414/684.3 |
| 5,804,038 | A * | 9/1998 | Nelsen | 201/39 |
| 7,534,326 | B1 * | 5/2009 | Doerksen et al. | 201/3 |
| 7,666,279 | B2 * | 2/2010 | Cihlar et al. | 202/239 |
| 7,682,490 | B2 * | 3/2010 | Lah | 202/242 |
| 7,871,500 | B2 * | 1/2011 | Lah | 202/266 |
| 2007/0215452 | A1 | 9/2007 | Cihlar et al. | |

FOREIGN PATENT DOCUMENTS

| | | |
|---|---|---|
| CA | 2581842 | 9/2007 |
| CA | 2581842 A1 | 9/2007 |

OTHER PUBLICATIONS

Jaan Taagepera, "Coke Drum Support Design", Abstract, USA.
Jaan Taagerpera, "Alternative Coke Drum Skirt Designs", Pressure Vessel and Piping Design and Analysis, ASME 2001, pp. 41-46, PVP—vol. 430, USA.
John E. Baxter, "Design Optimization of Coke Drum Support Skirt", Fitness for Adverse Environments in Petroleum and Power Equipment, ASME 1997, pp. 299-306, PVP—vol. 359, USA.
John E. Baxter, "Optimization of Coke Drum Support Skirt for Faster Operating Cycles", ASME 1998, pp. 239-244, PVP—vol. 368, USA.
N. A. Weil et al., "Experience with Vessels of Delayed-Coking Units", Proceedings American Petroleum Institute, 1958, pp. 214-232, vol. 38 [III], American Petroleum Institute.
American Petroleum Institute, Proceedings—Section III—Refining, 1958, vol. 38[III], pp. 214-232.

* cited by examiner

*Primary Examiner* — Nina Bhat
(74) *Attorney, Agent, or Firm* — Malcolm D. Keen; Glenn T. Barrett

(57) ABSTRACT

A delayed coking unit with a coking drum having an upper cylindrical portion and a lower frusto-conical portion is supported by means of a support structure surrounding the cone frustum of the lower portion of the drum; the support structure comprises a cone support member having a concave frusto-conical support surface mating with the outer convex cone frustum of the lower portion of the drum so that the drum sits in the cone support element. The support structure further has a weight supporting member or members attached to the cone support member intermediate its upper and lower peripheries which acts or act to transfer the weight of the drum (and contents) downwards to a suitable sub-structure such as a concrete slab. In a preferred embodiment, the drum may also be stayed against lateral forces by means of guide members at the upper portion of the drum.

4 Claims, 3 Drawing Sheets

COKING DRUM SUPPORT SYSTEM

FIELD OF THE INVENTION

This invention relates to a system for supporting a delayed coking drum used for the thermal processing of heavy petroleum oils.

BACKGROUND OF THE INVENTION

Delayed coking is a process used in the petroleum refining industry for increasing the yield of liquid product from heavy residual oils such as vacuum resid. In delayed coking, the heavy oil feed is heated in a furnace to a temperature at which thermal cracking is initiated but is low enough to reduce the extent of cracking in the furnace itself. The heated feed is then led into a large drum in which the cracking proceeds over an extended period of residence in the drum. The cracking produces hydrocarbons of lower molecular weight than the feed which, at the temperatures prevailing in the drum, are in vapor form and which rise to the top of the drum where they are led off to the downstream product recovery unit with its fractionation facilities. The thermal cracking of the feed which takes place in the drum also produces coke which gradually accumulates in the drum during the delayed coking cycle. When the coke reaches a certain level in the drum, the introduction of the feed is terminated and the cracked products remaining in the drum removed by purging with steam. After this, the coke is quenched with water and then discharged through the bottom of the drum, usually by hydraulic jetting or cutting with high pressure water jets followed by the "unheading" or the opening of the drum discharge valve or chute at the drum bottom. The cracking cycle is then ready to be repeated.

Delayed coking drums are conventionally large vessels, typically at least 4 and possibly as much as 10 m in diameter with heights of 10 to 30 m. or even more. The drums are usually operated in twos or threes with each drum sequentially going through a charge-quench-discharge cycle, with the heated feed being switched to the drum in the feed phase of the cycle. The drums are typically made of unlined or clad steel, from about 10 to 30 mm. thick. In form, the drums comprise vertical cylinders with a lower frusto-conical portion between the upper cylindrical portion and a lower portion of reduced diameter which at its lower extremity has either a bottom closure disk or, alternatively, a mechanical valve arrangement as described, for example, in U.S. Pat. No. 6,843,889 (Lah). The feed and steam inlet or inlets may be located in this lower portion or alternatively, in a drum closure disk which seals off the coke discharge opening at the bottom of the drum.

The coking drum is conventionally supported by means of a skirt which is welded to the drum around the lower periphery of the main cylindrical portion of the drum; the skirt transmits the weight of the drum downwards to the underlying support structure and also resists lateral forces generated by wind or seismic movements.

This conventional welded skirt support has long been recognized as a source of problems. Cracking of the skirt attachment weld has been the most prolific difficulty to the extent that instances have been reported of the drum actually becoming separated from the skirt and being left to sit loosely upon the skirt, as reported in Proc. Am. Pet. Inst. 38 [III], 214-232 (1958) (Weil et al), see especially, page 219. If this occurs, the drum no longer has adequate resistance to lateral movement or loading, a situation which cannot long be allowed to continue.

A number of factors contribute to the weakness in the weld in this area, a problem which appears to be largely unique to coking drum design and not shared by other process tower installations, as noted by Weil (page 218). First, the heating and quenching characteristic of the process, recurring at intervals of 12-24 hours, produces repeated expansion and contraction cycles in which the drum movement may not be replicated in the skirt because the skirt has a relatively large air-cooled surface area so that it remains at a temperature below that of the drum rather in the manner of the handle on a skillet. Hoop stresses are generated with resulting weld stress leading to eventual failure. In addition, lateral forces on the drum transferred to the skirt through the weld induce transverse weld stress which may literally crack the weld and open a gap between the skirt and the drum. Aside from these problems, geometric discontinuities and failure to properly relieve weld stresses may accelerate weld failure in the already stressful environment. In the industry, these problems have led over the years to considerable analysis and consideration of techniques for improvement of the weld between the skirt and the drum but, prior to the present invention, no satisfactory solution has been achieved.

SUMMARY OF THE INVENTION

We have now devised an improved support system for delayed coking drum which eliminates the problems associated with the conventional structure with its welded-on skirt. Our system eliminates the attachment weld between the body of the drum and the support structure and so, in turn, eliminates constraint stresses and the possibility of weld crack formation. The configuration of the lower portion of the drum is used effectively to create a safe, stable, relatively stress-free mounting for the drum.

According to the present invention, a delayed coking drum having an upper cylindrical portion and a lower frusto-conical portion joined to the upper cylindrical portion is supported by means of a support structure surrounding the cone frustum of the lower portion of the drum. The support structure comprises a cone support member having a concave frusto-conical support surface mating with the outer convex cone frustum of the lower portion of the drum so that the drum sits in the cone support member. The support structure further has a weight supporting structure attached to the cone support member intermediate its upper and lower peripheries which acts or act to transfer the weight of the drum (and contents) downwards to a suitable sub-structure such as a concrete slab. In a preferred embodiment, the drum is stayed against lateral forces by means of guide members at the upper portion of the drum.

DRAWINGS

For clarity, the fire proofing required for all weight-bearing steel members is not shown in any of the Figures.

DETAILED DESCRIPTION

Figure 1:
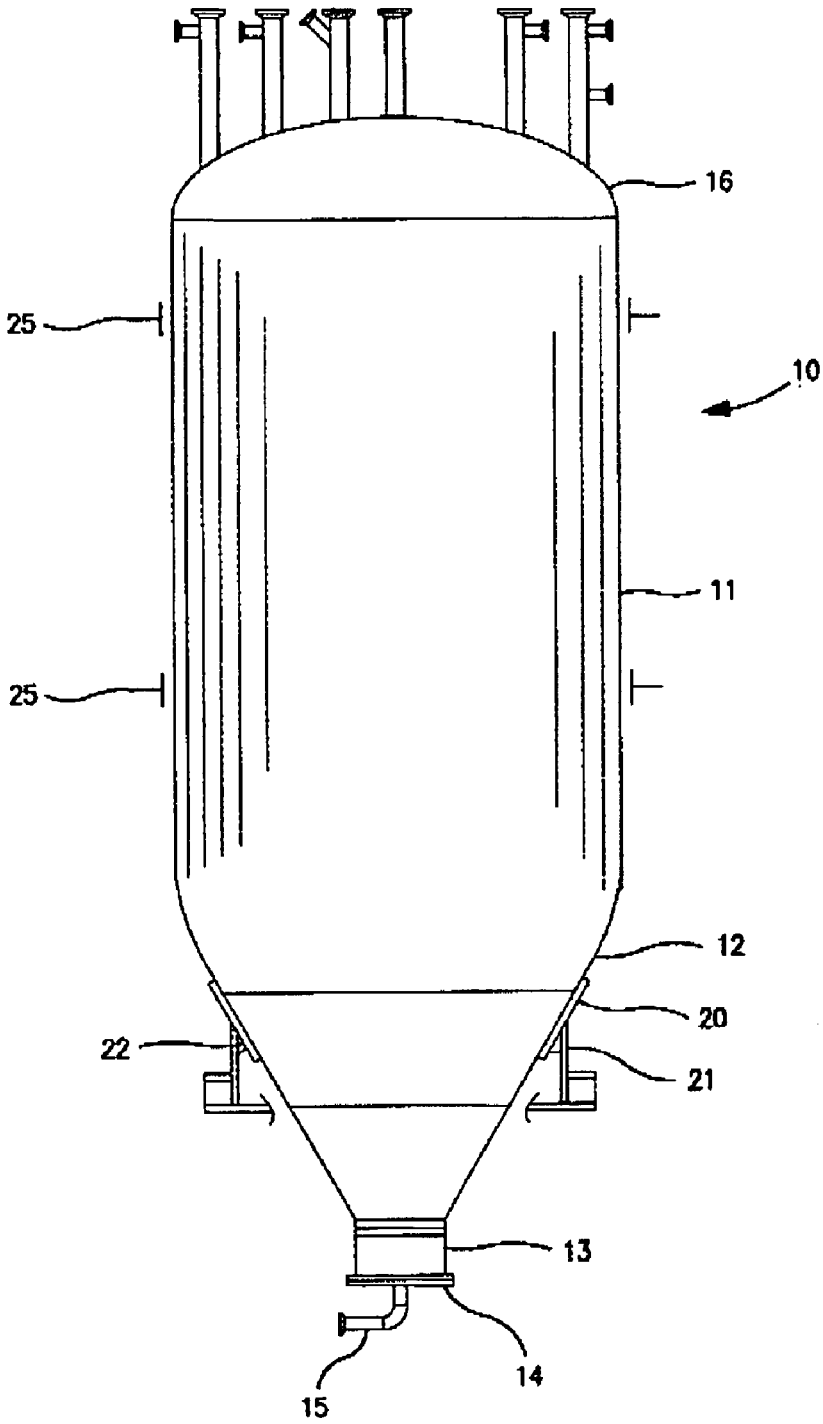
FIG. 1 is a simplified elevational section of a coker drum and support system according to a preferred embodiment of the invention.
Figure 2:
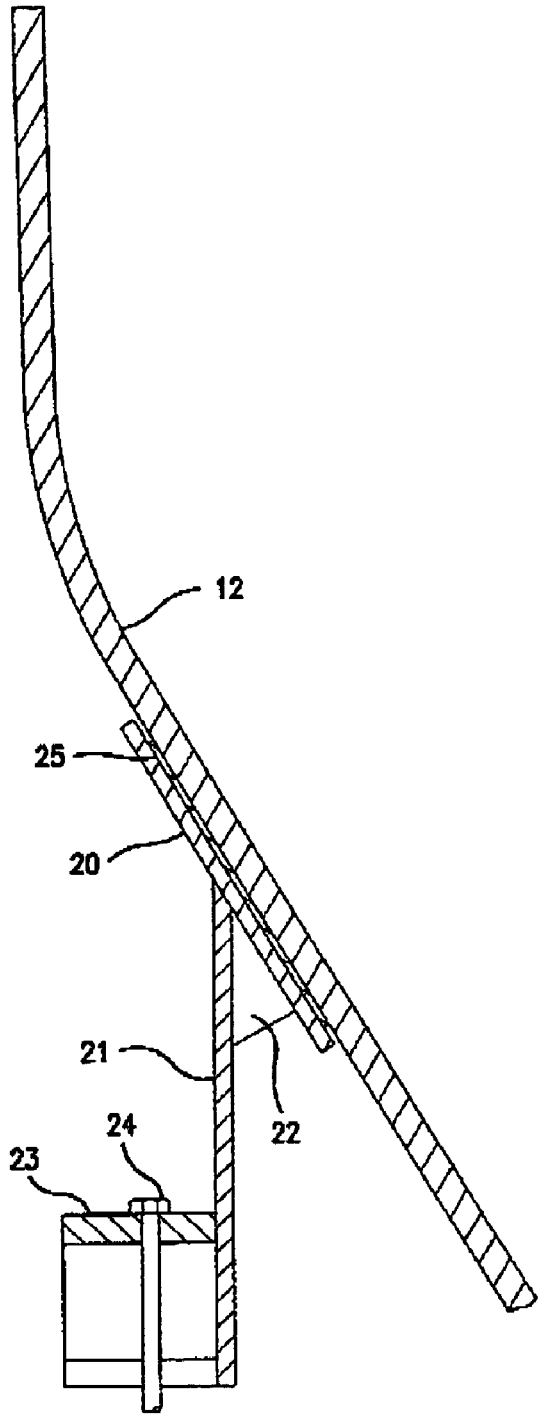
FIG. 2 is an enlarged section of a portion of the lower portion of the drum and its mating support structure.

A preferred embodiment of the invention is shown in FIGS. 1 and 2. The vertical coker drum 10 has an upper cylindrical section 11 joined to an immediately lower frusto-conical section 12; the juncture between these two sections is preferably formed by a curved plate knuckle structure although a welded seam may be tolerated. Frusto-conical section 12 leads down to the bottom section 13 with a coke discharge opening. The discharge opening is closed by means of a closure disk 14 over the discharge opening with an inlet line 15 used for feed and steam injection. The drum is closed at the top end by means of a removable upper header 16 containing outlets for hydrocarbon vapors and steam. This header can be swung out of the way when coke cutting operations are to take place so that the cutting head may be lowered down into the drum from above.

The support structure for the drum comprises a cone support member 20 in the form of a frustum of a cone which encircles the lower conical portion 12 of the drum and mates with the exterior convex conical face of the lower portion of the drum to bear the downward thrust of the drum and its contents. The cone support member 20 is in turn supported by upstanding weight supporting structural member 21 comprising an upright circular skirt in the form of a cylinder open at both ends, attached as by welding to the under surface of cone support member 20 between the two ends of frustum 20, preferably between the $20^{th}$ and $80^{th}$ percentiles of slant length of the frustum. A series of gussets 22 are fixed between cone support member 20 and skirt 21 around the inner periphery of the skirt at its juncture with the cone support member in order to provide added strength and stability to the support structure and increase the length of weld joining cone support member 20 to skirt 21. The weight supporting skirt 21 is fixed to an anchor 23 which is itself fixed to a sub-structure such as a concrete slab on which the entire unit is built. Suitably, the anchors are held in place by bolts 24 strong enough to resist the lateral forces generated by the weight of the drum and contents. The skirt may be apertured if required for access to the lower portion of the drum, e.g. for feed or steam lines.

The upper portion of the drum has lateral guides 25 which prevent excessive sway in high winds or in the event of seismic displacements. The guides may be located around the drum at, (for example, three or four locations to provide stability along the two horizontal axes and at vertically-spaced intervals adequate to provide the necessary resistance to imposed lateral wind and predicted seismic forces. One or more vertical locations will in most cases provides adequate lateral support with the guides attached suitably to the surrounding drum support structure. The guides do not need to be in contact with the drum and, in fact, it is preferred that sufficient clearance should be provided between the outside of the drum and the guides to allow for the radial expansion which takes place during the cracking portion of the coking cycle. Spring mounted supports could be used to accommodate potential thermal drum distortions which may not be purely vertical.

Notably, in the present case, the support structure is not welded to the drum at any point: the drum sits in the support structure and is held in place by its weight with additional lateral support provided by guides 25. During operation, the drum will expand and contract depending upon the part of the coking cycle which is taking place in the drum. During the cracking phase, when heated feed is being introduced into the drum, the drum expands and if the support structure is sturdy enough, the radial expansion will be taken up in part by upward movement of the drum within the support structure, for which reason allowance should be made in design for this movement. In the case of a support member which completely encircles the drum, heat transfer to the support member will take place and radial outward expansion of the support member will accompany the expansion of the drum. The support member will, however, remain cooler than the drum and will not expand as much so that provision still needs to be made for vertical, upward drum movement. If a number of separate support members are used, similar considerations will apply, depending on the extent of movement of the support columns.

As described above, the upstanding circular support element 21 is fixed to the under surface of frustum 20 between the two ends of frustum 20, preferably between the $20^{th}$ and $80^{th}$ percentiles of slant length of the frustum with attachment optimal between the $40^{th}$ and $60^{th}$ percentiles of slant length with a further preference given to attachment between the $40^{th}$ and $50^{th}$ percentiles of slant length, measured from the bottom edge of the support member. If support columns are used to transfer the weight to the sub-structure, the same attachment locations would be considered preferable.

Figure 3:
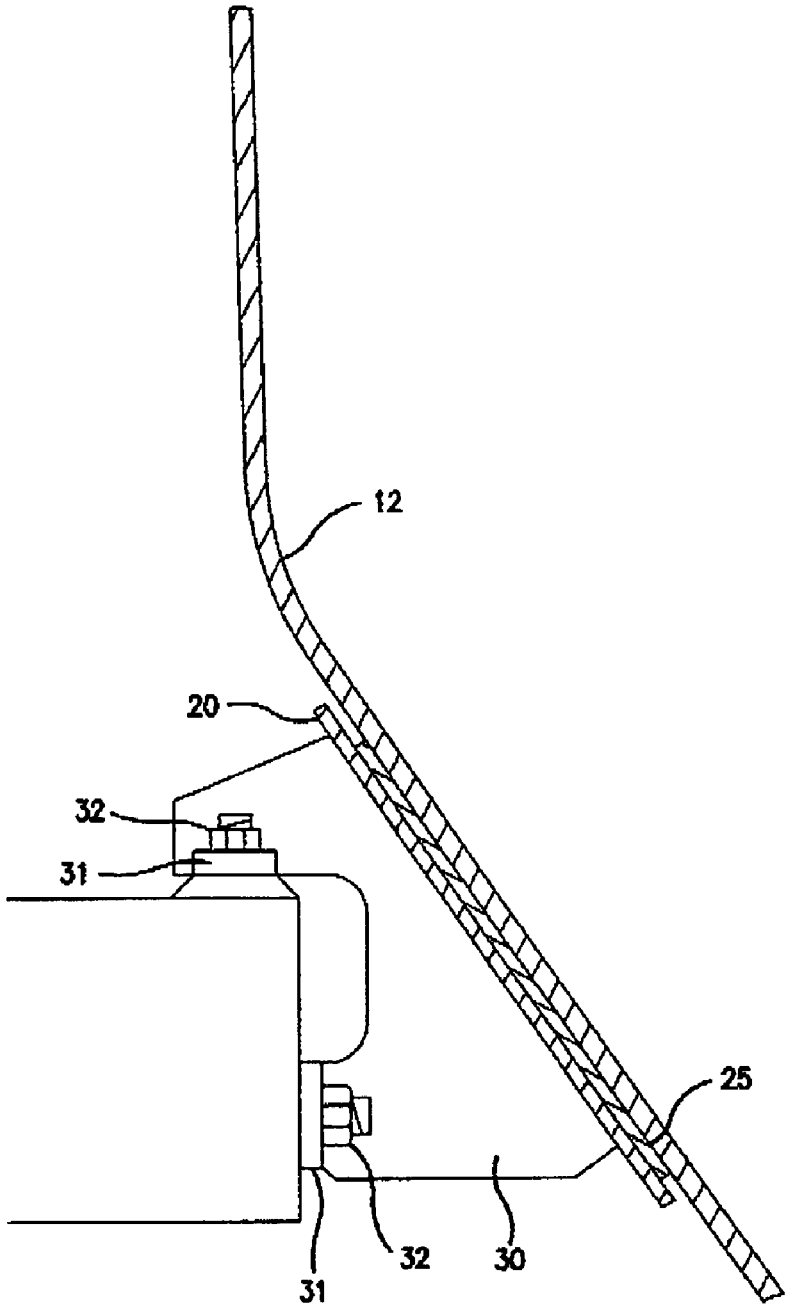
FIG. 3 is a simplified section of the drum with an alternative from of weight support.

The inner support face of support member 20 is preferably provided with an optional cladding 25 to prevent galling and to facilitate relative sliding movement between the drum and the cone support member. Stainless steel is adequate for this purpose but, if desired, a thermal break between the drum and the support member may be provided by using a cladding with high temperature, heat insulating properties, for example, a compressed mineral fibre material similar to brake pad or clutch lining. The provision of the thermal break would reduce the thermal cycling in the cone support member and, consequently, the weld cracking that might otherwise occur. An alternative form of weight-support structure is shown in FIG. 3. In this case, the cone support member 20 is itself supported by means of a plurality of radial support gussets 30 only one shown in FIG. 3). Each gusset 30 extends radially outwards from cone support member 20 to the concrete base structure of the unit 31 which is apertured to receive the lower portion of drum 12. Each radially extensive gusset 30 is secured to the base structure by means of flange plates 31 secured by holding bolts 32 embedded in the concrete so that the cone support member extends to one or more anchor point supports spaced away from the drum. The number of gussets 30 is selected to bear the loaded weight of the structure and associated stresses; at least four and preferably more, e.g. five, six, eight or even twelve, such gussets are provided in order to reduce the load at each gusset and to provide even support around the periphery of the cone. The inner surface of cone support member 20 is, again, lined with cladding 25 of stainless steel or insulating material as described above.

The invention claimed is:

1. A delayed coking unit having a coking drum comprising an upper cylindrical portion and a lower frusto-conical portion joined to the upper cylindrical portion, the drum being supported by means of:

a cone support member which comprises a complete cone frustum around the lower portion of the drum surrounding the cone frustum of the lower portion of the drum and has a support face comprising a concave frusto-conical surface mating with the outer convex cone frustum of the lower portion of the drum to receive the lower portion of the drum with a layer of high-temperature, heat-insulating material between the lower portion of the drum and a bearing surface of the support member and (ii) a weight supporting structure comprising a upstanding circular skirt in the form of an open-ended cylinder attached to the cone support member intermediate the upper and lower edges of the cone support member.

2. A delayed coking unit according to claim 1 in which the skirt is apertured below its point of attachment to provide access to the bottom of the drum.

3. A delayed coking unit according to claim 1 in which the circular skirt is attached to the cone support intermediate the $20^{th}$ and $80^{th}$ percentiles of the slant length of the cone support.

4. A delayed coking unit according to claim 3 in which the circular skirt is attached to the cone support intermediate the $40^{th}$ and $60^{th}$ percentiles of the slant length of the cone support.

* * * * *